United States Patent [19]

Matsumoto et al.

[11] 4,069,768

[45] Jan. 24, 1978

[54] DEVICE FOR CONTROLLING A PROPAGATION DIRECTION OF NOISE

[75] Inventors: Masayasu Matsumoto, Zushi; Kazuyoshi Iida, Yokohama; Yoshikazu Kondo, Yokohama; Keiichiro Mizuno, Yokohama; Sadao Nomoto, Yokohama; Noriaki Murayama, Kawasaki; Kei Watanabe, Yokohama, all of Japan

[73] Assignee: Bridgestone Tire Company Limited, Tokyo, Japan

[21] Appl. No.: 686,338

[22] Filed: May 14, 1976

[30] Foreign Application Priority Data

| | | |
|---|---|---|
| May 28, 1975 | Japan | 50-63683 |
| May 28, 1975 | Japan | 50-63684 |
| June 2, 1975 | Japan | 50-66157 |
| Dec. 29, 1975 | Japan | 51-157979 |
| Dec. 29, 1975 | Japan | 51-157980 |
| Feb. 18, 1976 | Japan | 51-16687 |
| Apr. 14, 1976 | Japan | 51-41318 |

[51] Int. Cl.[2] ..... B61D 17/00; B61K 13/00

[52] U.S. Cl. ..... 105/452; 104/1 R; 104/124; 181/210

[58] Field of Search ..... 105/452; 104/1 R, 124; 295/7; 181/33 E, 33 GD, 33 HE, 33 L, 49, 63, 70, 33 G

[56] References Cited

U.S. PATENT DOCUMENTS

| | | | |
|---|---|---|---|
| 2,726,830 | 12/1955 | Brown et al. | 181/33 HE |
| 3,111,191 | 11/1963 | Bachert | 181/70 X |
| 3,177,970 | 4/1965 | Boschi | 181/33 G |
| 3,212,453 | 10/1965 | Lich | 105/452 X |
| 3,772,993 | 11/1973 | Noble et al. | 104/1 R |
| 3,812,931 | 5/1974 | Hauskins, Jr. | 181/33 L X |
| 3,830,335 | 8/1974 | Zorumski | 181/33 L X |

FOREIGN PATENT DOCUMENTS

| | | | |
|---|---|---|---|
| 2,158,702 | 6/1973 | Germany | 181/70 |

*Primary Examiner*—Robert J. Spar
*Assistant Examiner*—Randolph A. Reese
*Attorney, Agent, or Firm*—Sughrue, Rothwell, Mion, Zinn and Macpeak

[57] ABSTRACT

A device for controlling a propagation direction of noise which is preferably associated with a sound insulating wall to significantly improve its sound reducing effect of alleviating noise emitted from a noise source such as a railroad, highway and the like on which an electric car and automobiles run. The device comprises a hollow structural body composed of a plurality of elongate hollow passages superimposed one upon the other and spaced apart from each other. The passages are arranged in a propagation direction of noise emitted from the noise source and serve to refract and lag in phase the noise passed therethrough, thereby producing a sound reducing region located intermediate between a direct propagation sound and the refraction propagation sound.

12 Claims, 48 Drawing Figures

DEVICE FOR CONTROLLING A PROPAGATION DIRECTION OF NOISE

This invention relates to devices for controlling a propagation direction of noise and alleviating influence of the noise upon a sound receiving region and more particularly to a device for controlling propagation direction of noise which is associated with a sound insulating wall to significantly improve its sound reducing effect of alleviating noise emitted from a noise source such as a railroad, highway and the like on which an electric car and automobiles run.

A sound insulating wall and the like has been developed for the purpose of alleviating a public nuisance caused by various kinds of noises. In order to alleviate such noise measurements of counteracting the effects of a noise source have been attempted. Such measurements, however, have limits and are often difficult to perform.

As means for reducing noise, it has been the common practice to provide a barrier such as a sound insulating wall and the like and arrange it between a noise source and a noise receiving region for the purpose of intercepting propagation of the noise or provide a barrier constructed to completely surround a noise source and shield it.

However, it is a matter of course that the former barrier is limited in its sound insulating effect, while the latter barrier requires other means such as a heat dissipation device, a ventilation device and the like and hence becomes complex in construction and eventually is difficult to be carried out into effect.

As means for insulating noise produced from vehicles such as a high speed electric car running on an elevated railroad and the like, use has been made of a sound insulating wall. That part of noise which passes over the upper edge of the sound insulating wall causes the sound insulating wall to reduce its sound insulating effect to at most 20 dB. Particularly, a sound insulating wall provided at a position where one can see a noise source has substantially no effect.

In order to obviate such disadvantage, attempts have been made to provide a shelter wall arranged along a railroad and surrounding the overall length thereof. But, such a shelter wall prevents houses adjacent thereto from being exposed to the sun, is expensive, requires a ventilation device, interrupts passenger's visual field, etc. and hence is difficult to use operationally.

The above mentioned problem has also been encountered with means for insulating noise produced from automobiles run on roads and from a power driven unit provided for industry.

An object of the invention, therefore, is to provide a device for controlling a propagation direction of noise, which is simple in construction and can eliminate the above mentioned problem.

Another object of the invention is to provide a device for controlling a propagation direction of noise, which not only can control the propagation direction of noise but also can produce a region where noise is significantly reduced.

A feature of the invention is the provision of a device for controlling a propagation direction of noise, comprising a hollow structural body composed of a plurality of elongate hollow passages superimposed one upon the other with spaced apart from each other, said passages being arranged in a propagation direction of noise emitted from a noise source, whereby a part of noise emitted from the noise source is refracted when passed through the elongate hollow passages and becomes lagged in phase with respect to a direct propagation sound emitted from the noise source and passed over the upper edge of the hollow structural body and the refracted propagation sound is interfered with the direct propagation sound to produce a sound reducing region located intermediate between the direct propagation sound and the refraction propagation sound.

The invention will now be described in greater detail with reference to the accompanying drawings, wherein.

Figure 23A:
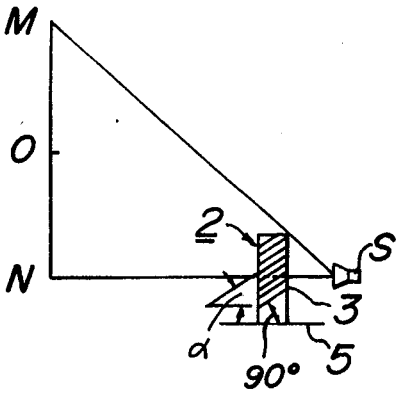
Figure 23B:
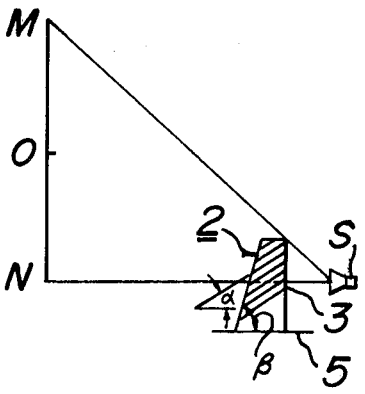
Figure 23C:
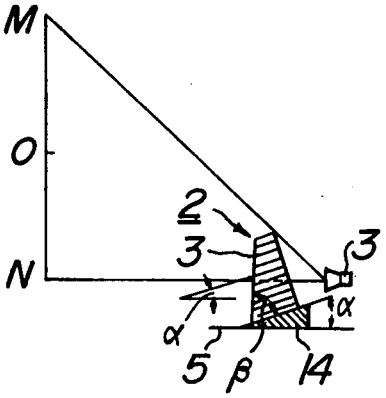
Figure 24:
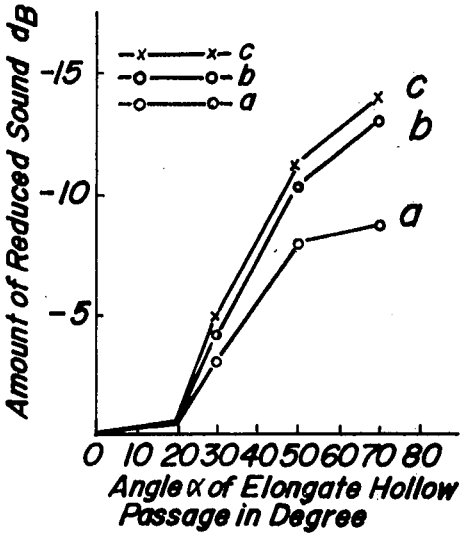

FIGS. 23(*a*), 23(*b*) and 23(*c*) are diagrammatic views showing a further experimental test apparatus;

FIG. 24 is a graph illustrating the result yielded from the experimental test apparatus shown in FIGS. 23(*a*), 23(*b*) and 23(*c*).

Figure 13:
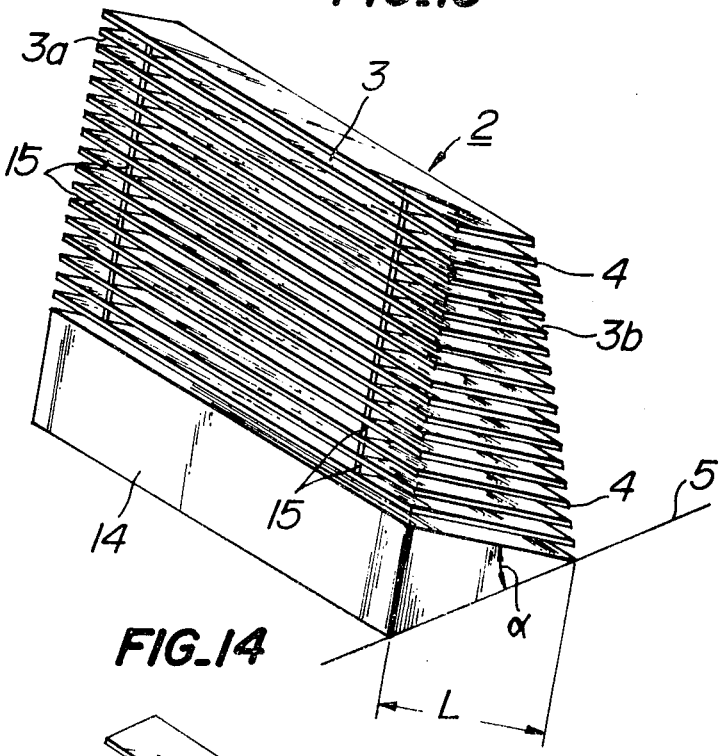
FIG. 13 is a perspective view of one embodiment of the device according to the invention which comprises a hollow structural body composed of a plurality of downwardly inclined elongate hollow passages.
Figure 17:
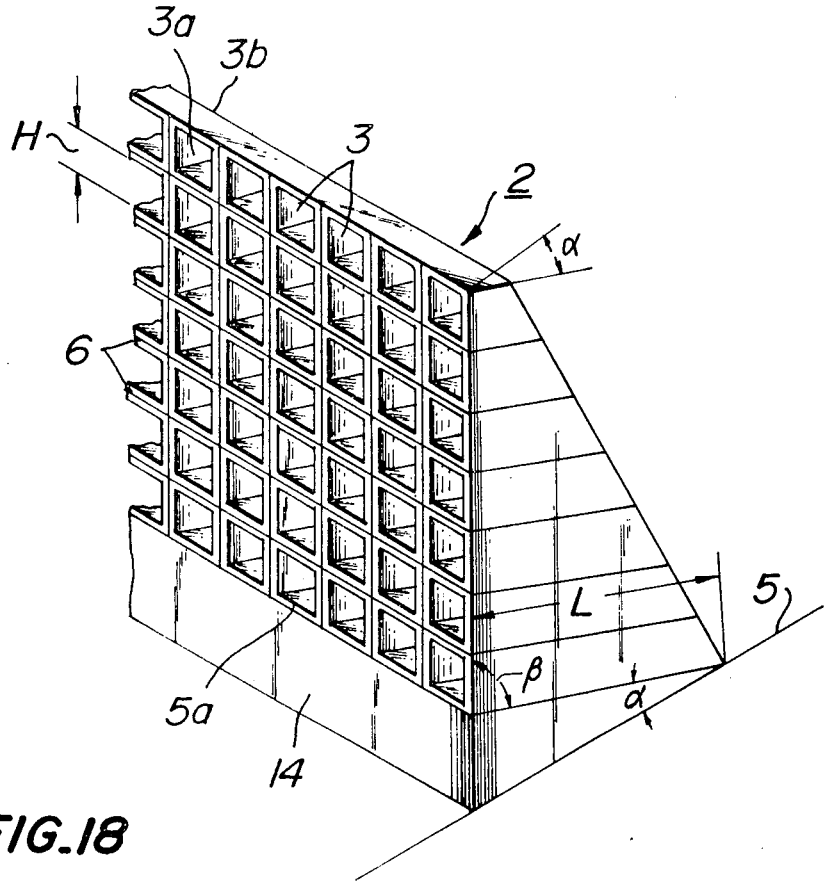
FIG. 17 is a perspective view of another embodiment of the device according to the invention which comprises a hollow structural body composed of a trapezoid block having a plurality of square honeycomb-shaped elongate hollow passages.
Figure 21:
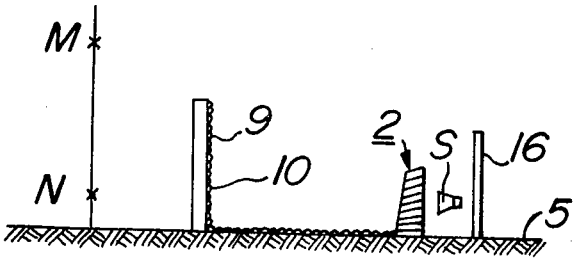
FIG. 21 is a front elevational view showing an experimental test apparatus.
Figure 25:
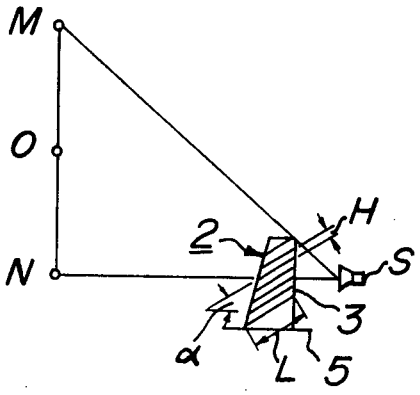
Figure 26:
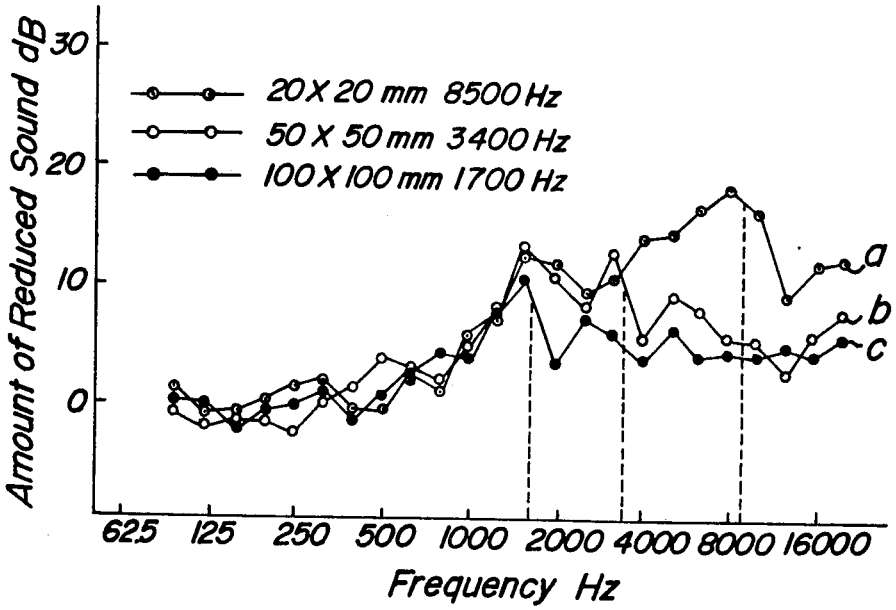
Figure 27:
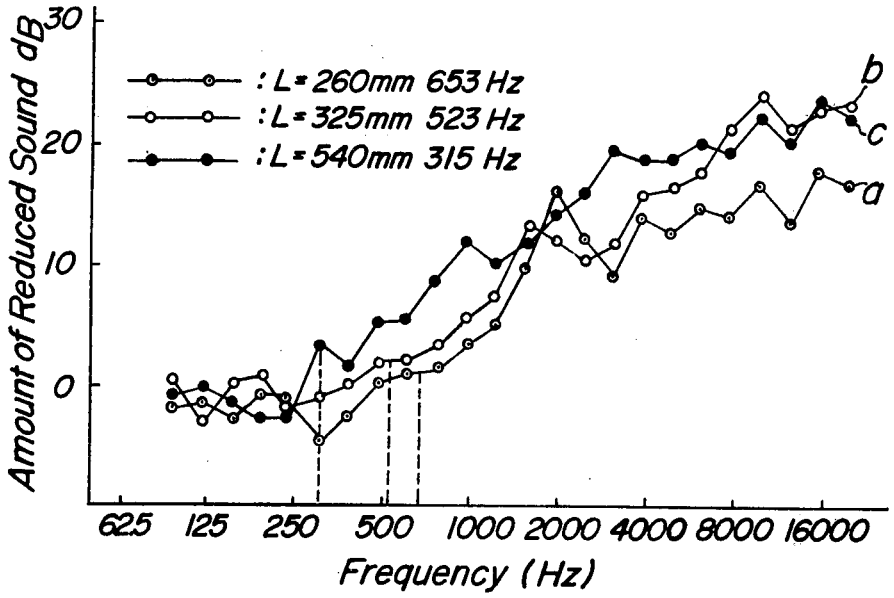
Figure 28:
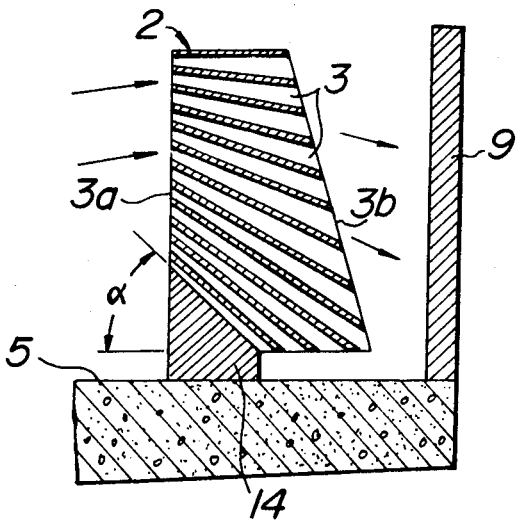
Figure 29A:
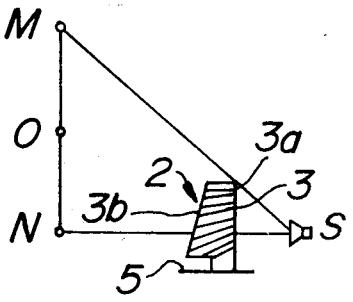
Figure 29B:
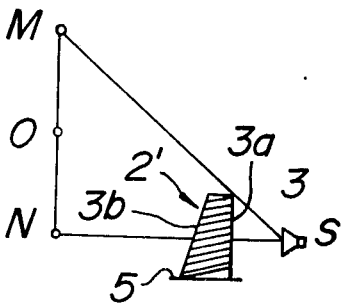
Figure 30A:
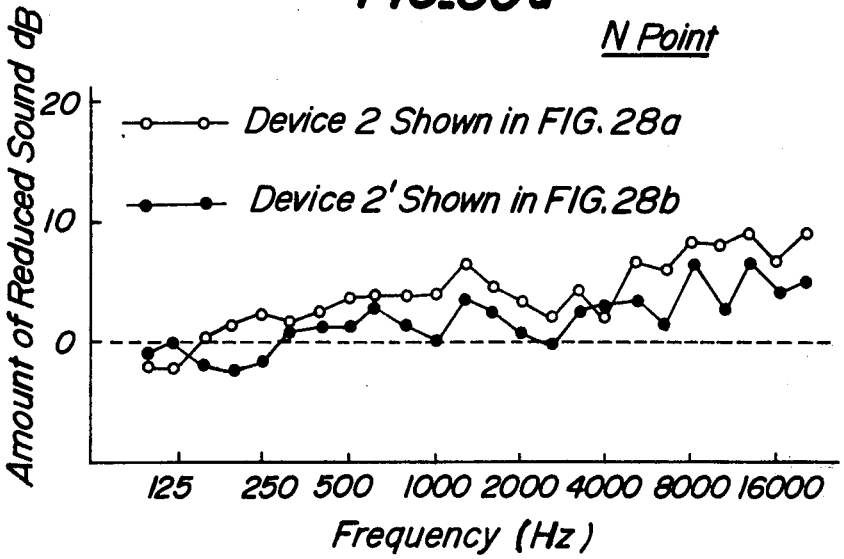
Figure 30B:
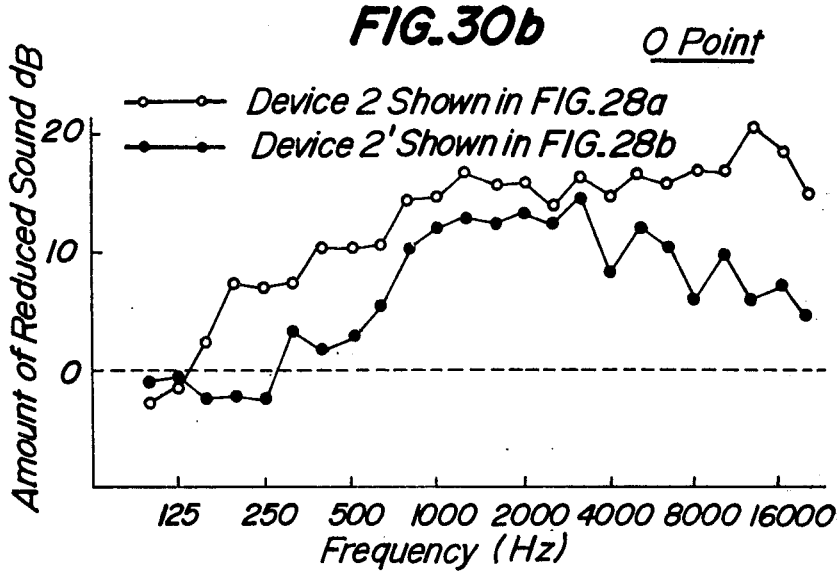
Figure 31:
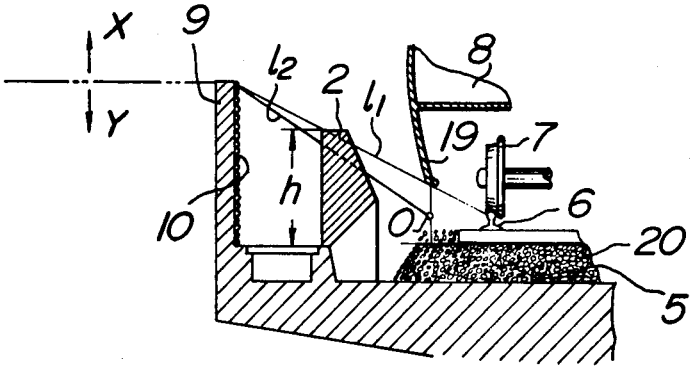
Figure 32:
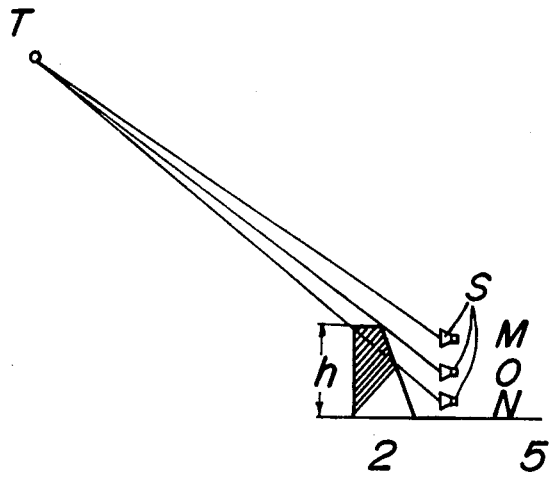
Figure 33:
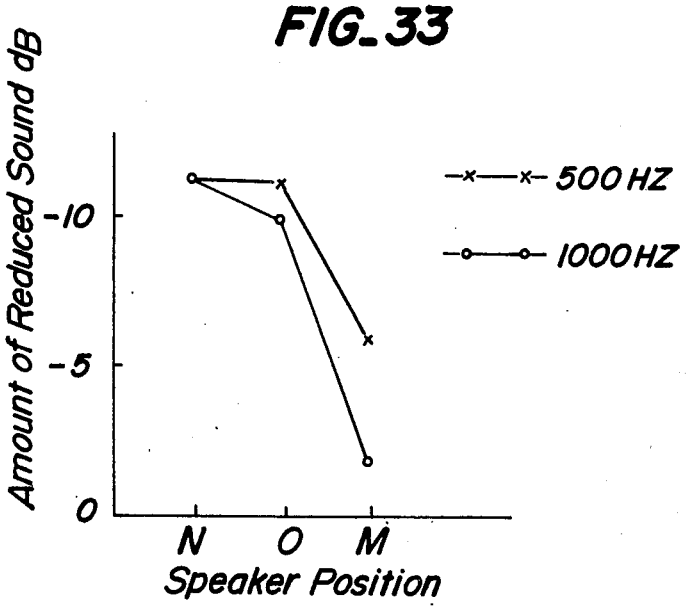
Figure 34:
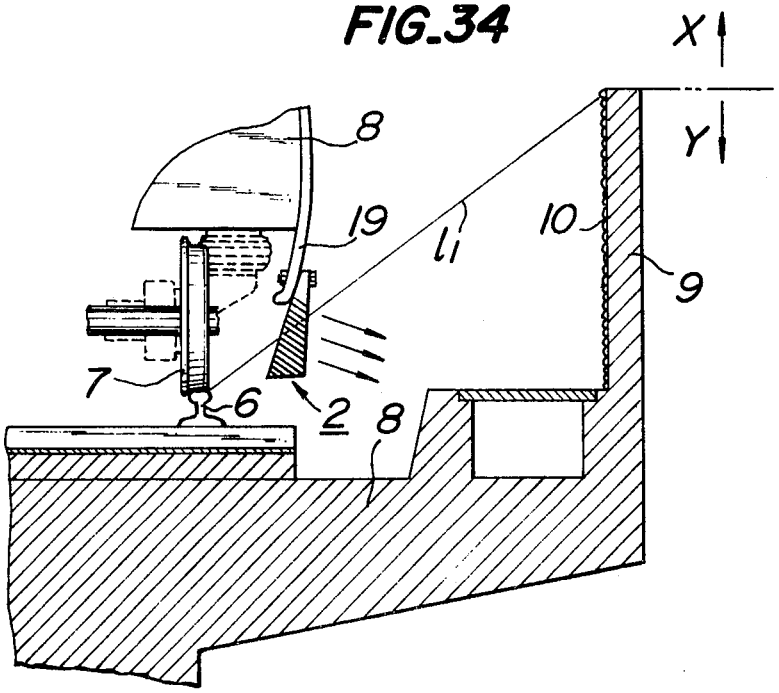
Figure 35:
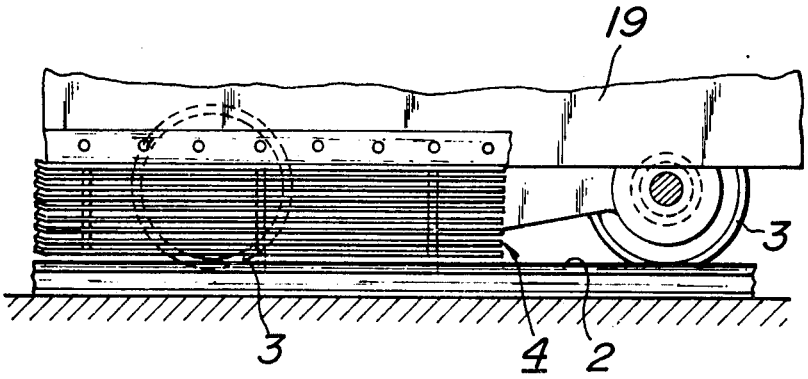
Figure 36:
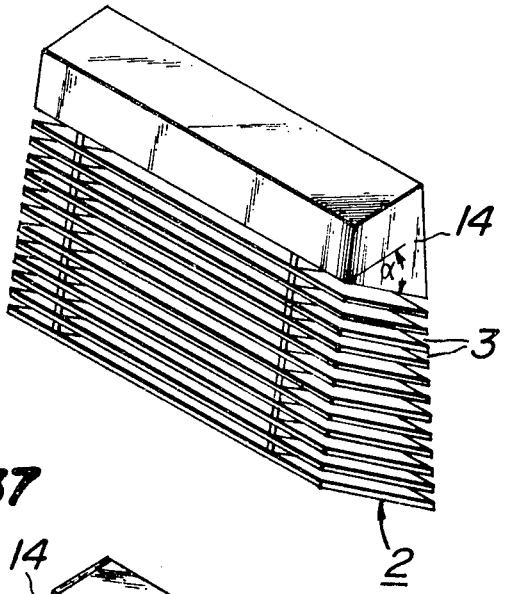
Figure 37:
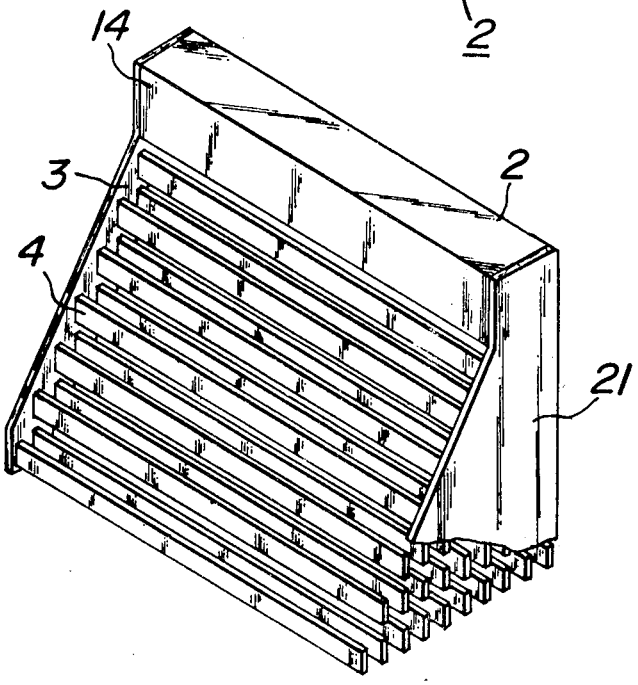
Figure 38:
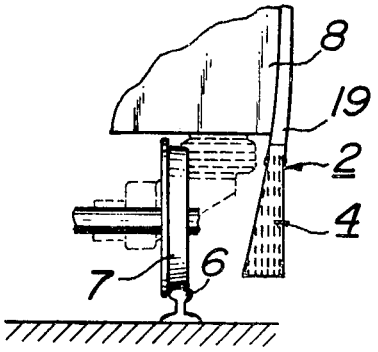
Figure 39:
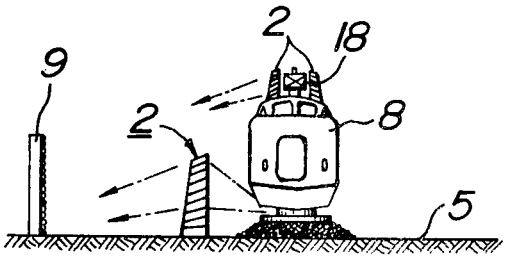
Figure 40:
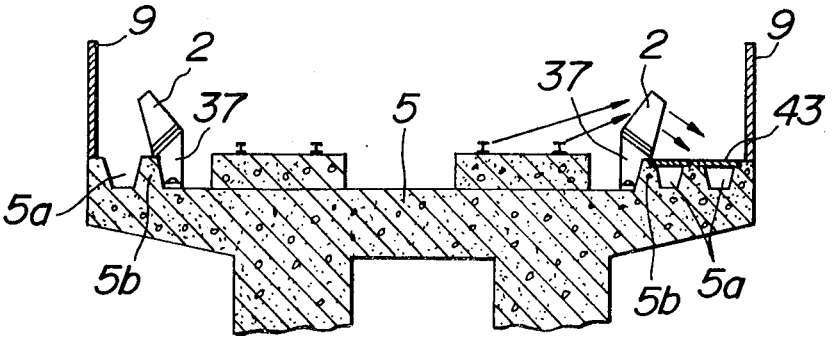
Figure 41:
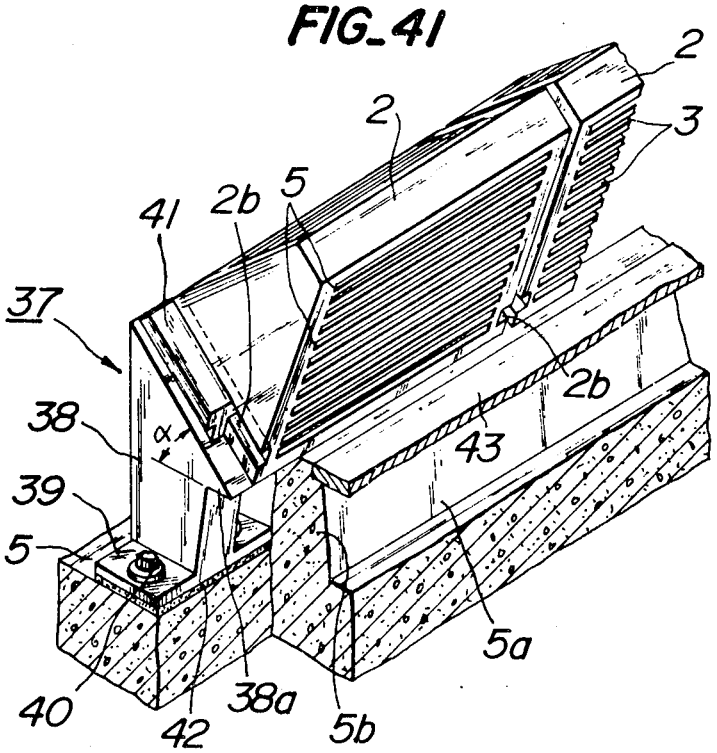
Figure 42:
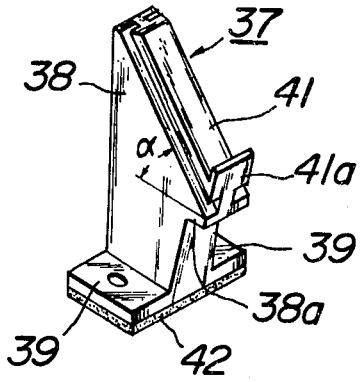
Figure 43:
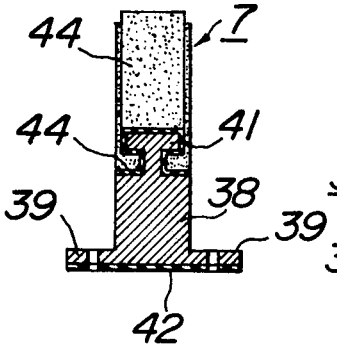

FIG. 25 is a diagrammatic view showing a still further experimental test apparatus;

FIGS. 26 and 27 are graphs illustrating the result yielded from the experimental test apparatus shown in FIG. 21;

FIG. 28 is a cross sectional view of another modified embodiment of the device shown in FIG. 17;

FIGS. 29(*a*) and 29(*b*) are diagrammatic views showing an experimental test apparatus for the device shown in FIG. 28;

FIGS. 30(*a*) and 30(*b*) are graphs illustrating the result yielded from the experimental test apparatus shown in FIGS. 29(*a*) and 29(*b*), respectively;

FIG. 31 is a cross sectional view showing an embodiment of the device shown in FIG. 13 associated with a side plate of an electric car and a sound insulating wall;

FIG. 32 is a diagrammatic view showing another experimental test apparatus;

FIG. 33 is a graph illustrating the result yielded from the experimental test apparatus as shown in FIG. 32;

FIG. 34 is a cross sectional view showing another embodiment of the device according to the invention secured to the lower peripheral edge of a side plate of an electric car;

FIG. 35 is its side elevational view;

FIGS. 36 and 37 are perspective views showing two embodiments of the device according to the invention adapted to be secured to the lower peripheral edge of a side plate of an electric car as shown in FIG. 34;

FIG. 38 is a front elevational view of the device shown in FIG. 37 whose upper edge is made integral with a lower peripheral edge of a side plate of an electric car;

FIG. 39 is a front elevational view showing one embodiment of the device shown in FIG. 13 mounted near a pantagraph of an electric car;

FIG. 40 is a cross sectional view showing the device according to the invention detachably mounted on a fixture secured to an elevated railroad substrate;

FIG. 41 is a perspective view of the fixture shown in FIG. 40 in an enlarged scale and partly in section;

FIG. 42 is a perspective view of a modified fixture;

FIG. 43 is its cross sectional view; and

Figure 44:
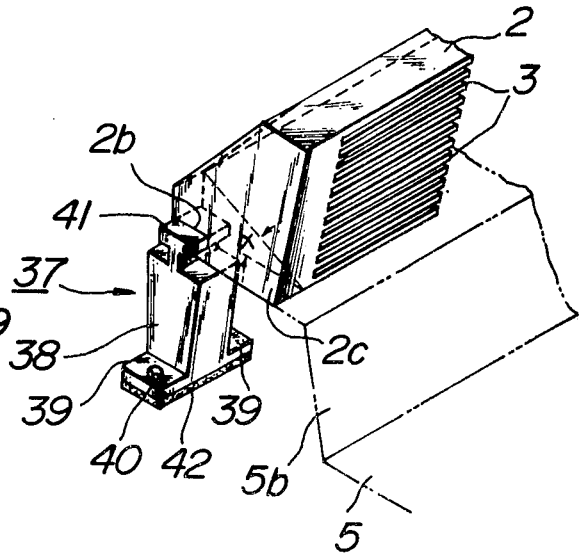

FIG. 44 is a perspective view of another modified fixture.

A principle of the device according to the invention will now be described with reference to FIGS. 1 to 4 which show sketches of photographs illustrating sound distributions produced in the absence and presence of the device according to the invention.

Figure 1:
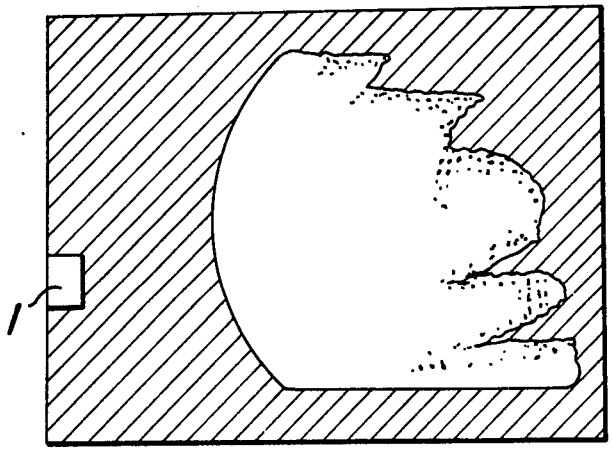
FIGS. 1 to 4 show sketches of photographs illustrating a principle of the device according to the invention.

In FIG. 1 is shown a sketch of photograph illustrating a distribution of $\frac{1}{3}$ octave band noise having a center frequency of 2,000 Hz and emitted from a noise source 1 in the absence of the device according to the invention.

Figure 2:
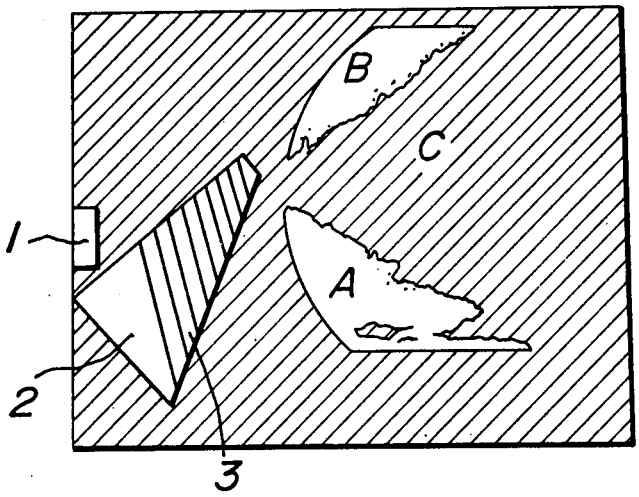

In FIG. 2 is shown a sketch of photograph illustrating a distribution of $\frac{1}{3}$ octave band noise having a center frequency of 2,000 Hz and emitted from a noise source 1 in the presence of the device 2 according to the invention.

As seen from FIG. 2, the presence of the device 2 according to the invention causes a part A of noise emitted from the noise source 1 and passed through a plurality of elongate hollow passages 3 of the device 2 to refract downwardly with respect to a direct propagation sound B passing over the upper edge of the device 2 without any refraction to produce a region C located intermediate between the direct propagation sound B and the refraction propagation sound A and significantly reducing sound.

Figure 3:
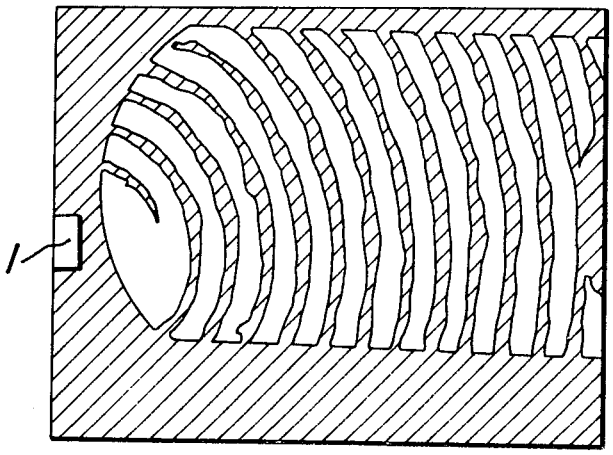

In FIG. 3 is shown a sketch of photograph illustrating a distribution of a pure tone having a frequency of 2,000 Hz and emitted from a sound source 1 subjected to sine wave oscillations in the absence of the device according to the invention.

Figure 4:
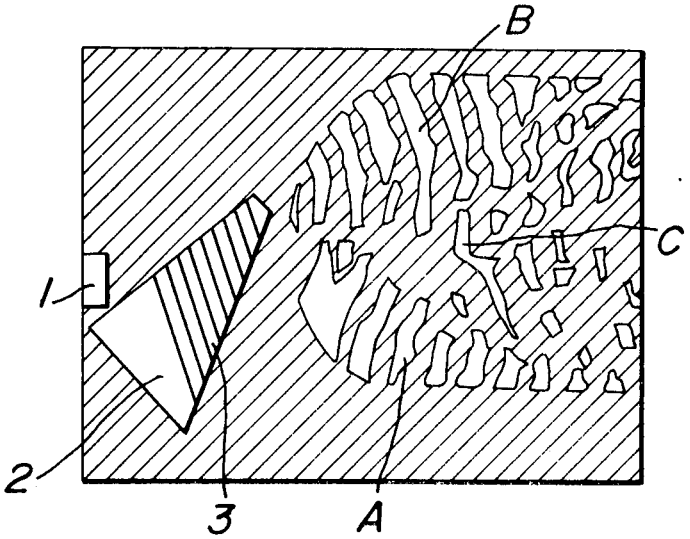

In FIG. 4 is shown a sketch of photograph illustrating a distribution of a pure tone having a frequency of 2,000 Hz and emitted from the sound source 1 subjected to sine wave oscillations in the presence of the device 2 according to the invention.

As seen from FIG. 3, the pure tone emitted from the sound source 1 is propagated in spherical wave with no phase lag. The presence of the device 2 according to the invention, however, causes a sound wave A passed through a plurality of elongate hollow passages 3 and propagated in a plane wave to refract downwardly and lag in phase with respect to a direct propagation sound B passing over the upper edge of the device 2 and propagated in a spherical wave, and as a result, a wave front at a region C located intermediate between the direct propagation sound B and the refraction propagation sound A becomes discontinuous as shown in FIG. 4. This discontinuous wave front at the region C shows that there is produced a destructive interference phenomenon. As a result, the sound reducing region C shown in FIG. 2 is produced. The above are the reasons why the sound reducing region C shown in FIG. 2 is produced.

The dimension of the sound reducing region C caused by the interference of the refraction propagation sound A with the direct propagation sound B is determined by the size of the device 2 according to the invention, the difference in length between adjacent elongate hollow passages 3, 3 of the device 2 and the position of the noise source 1.

That is, the upper boundary line of the sound reducing region C is aligned with a straight line connecting the noise source 1 to the upper edge of the device 2, while the lower boundary line of the sound reducing region C becomes more largely inclined downwardly as the difference in length between adjacent elongate hollow passages 3, 3 of the device 2 becomes more enlarged.

Figure 5:
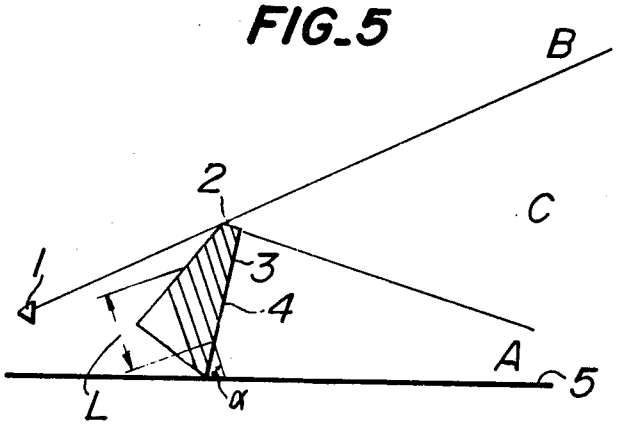
FIGS. 5 to 10 are diagrammatic views showing various embodiments of the device according to the invention in section and representative patterns of a refraction sound propagation region A, a direct sound propagation region B and an interference sound reducing region C, respectively.
Figure 10:
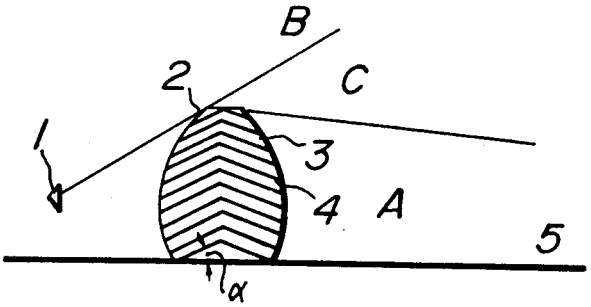

In FIGS. 5 and 10 are shown various embodiments of the device 2 according to the invention. All of these embodiments, except one shown in FIG. 10 and barrel-shaped in section, are trapezoid-shaped in section and comprise a hollow structural body composed of a plurality of elongate hollow passages 3 superimposed one upon the other and separated from each other.

As seen from FIGS. 5 to 10, if the outer contour of the device 2 and the difference in length L (FIG. 5) between adjacent elongate hollow passages 3, 3 are the same with each other, the refraction sound propagation region A, the direct sound propagation region B and the interference sound reducing region C are the same in pattern with each other irrespective of difference in the sectional shape of the elongate hollow passages 3. In addition, the refraction sound propagation region A, the direct sound propagation region B and the interference sound reducing region C may be produced at any desired position, respectively, in dependence with the size of the device 2 according to the invention, difference in length L between adjacent elongate hollow passages 3, 3 of the device 2 and the position of the noise source 1.

In the embodiment shown in FIG. 5, each elongate hollow passage 3 is formed between two adjacent parallel plates 4 spaced apart from each other and downwardly inclined from a substrate 5 by an angle $\alpha$.

Figure 6:
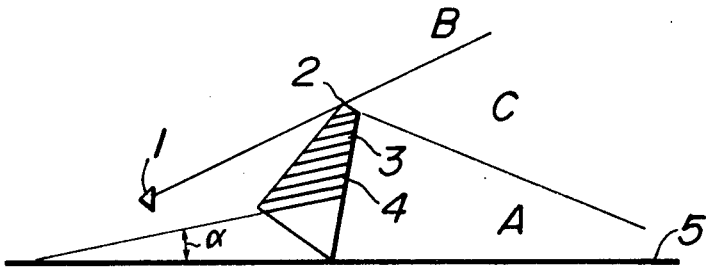

In the embodiment shown in FIG. 6, each elongate hollow passage 3 of the embodiment shown in FIG. 5 is upwardly inclined from the substrate 5 by an angle $\alpha$.

Figure 7:
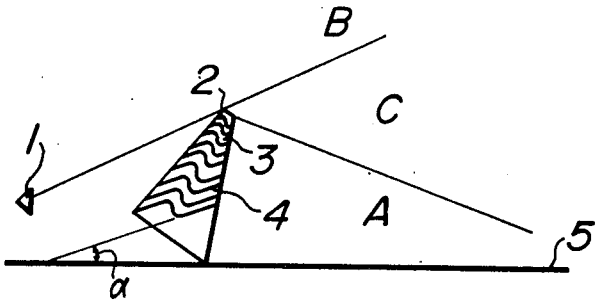

In the embodiment shown in FIG. 7, each elongate hollow passage 3 is formed between two adjacent corrugated plates 4, 4 spaced apart from each other and inclined upwardly from the substrate 5 by an angle $\alpha$.

Figure 8:
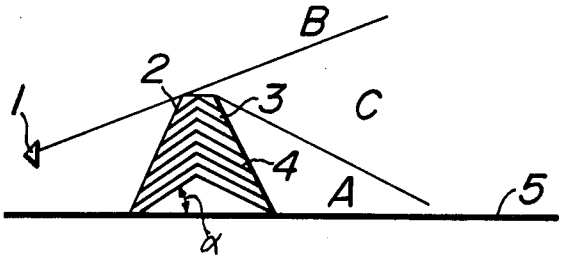

In the embodiment shown in FIG. 8, each elongate hollow passage 3 is formed between two adjacent triangular ridge-shaped plates 4, 4 spaced apart from each other, each side of the ridge being inclined from the substrate 5 by an angle $\alpha$.

Figure 9:
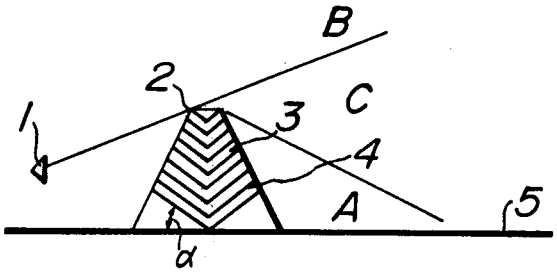

In the embodiment shown in FIG. 9, each elongate hollow passage 3 is formed between two adjacent triangular groove-shaped plates 4, 4 spaced apart from each other, each side of the groove being inclined from the substrate 5 by an angle $\alpha$.

In the embodiment shown in FIG. 10, each elongate hollow passage 3 is formed between two adjacent triangular ridge-shaped plates 4, 4 spaced apart from each other as in the case of FIG. 8, but the outer contour is of a barrel shape.

Figure 11:
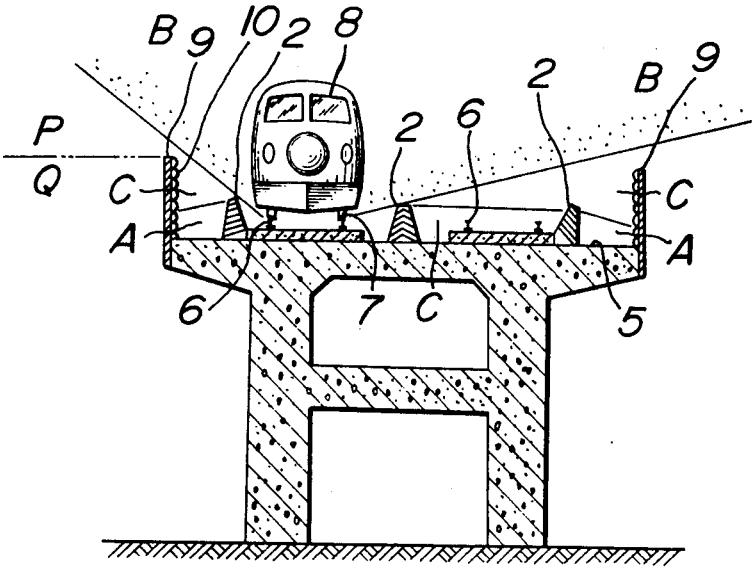
FIG. 11 is a front elevational view showing the device according to the invention in section which is applied to an elevated railroad so as to reduce noise produced by an electric car run on rails.

In FIG. 11 is shown the device 2 according to the invention applied so as to reduce noise produced from a contact portion of rails 6 with wheels 7 of an electric car 8, the rails 6 being arranged on an elevated substrate 5. Reference numeral 9 designates sound insulating walls arranged at both sides of the substrate 5 and opposed to each other. The sound insulating wall 9 is covered with a sound absorbing material 10 and constructed so as to absorb and intercept noise produced from the contact portion of the rail 6 with the wheel 7 in a conventional manner. In this case, the noise passed over the upper edge of the sound insulating wall 9 is freely propagated into a region P, so that substnatially no sound reducing effect is obtained therein. A part of the noise passed over the upper edge of the sound insulating wall 9 is refracted to a region Q located in the rear of the sound insulating wall 9, so that no excellent sound reducing effect is expected therein. Experimental tests have demonstrated that such sound reducing effect in the region Q is at most 20 dB.

In accordance with the invention, between the rail 6 and the sound insulating wall 9 is arranged the device 2 according to the invention shown in FIG. 5 which is constructed and arranged such that noise produced from the contact portion of the rail 6 with the wheel 7 is concentrically propagated toward the sound insulating wall 9 and at the same time the part of the noise passed over the upper edge of the sound insulating wall 9 is considerably reduced. For this purpose, the device 2 according to the invention is constructed and arranged such that the upper edge of the sound insulating wall 9 is located within the interference sound reducing region C and that the part of the noise which might be refracted into the region Q is intercepted by the sound insulating wall 9.

It is preferable to arrange the device 2 shown in FIGS. 8 and 9 at a position intermediate between the two opposed rails 6, 6 as shown in FIG. 11. The noise produced from the contact portion of the rail 6 with the wheel 7 is refracted and lagged in phase with respect to the noise passing over the upper edge of the device 2 when the noise passes through the elongate hollow passages 3, 3 of the device 2 to produce the interference sound reducing region C. In this case also, the upper edge of the sound insulating wall 9 is located within the interference sound reducing region C so as to intercept the refraction propagation sound by means of the sound insulating wall 9.

Figure 12:
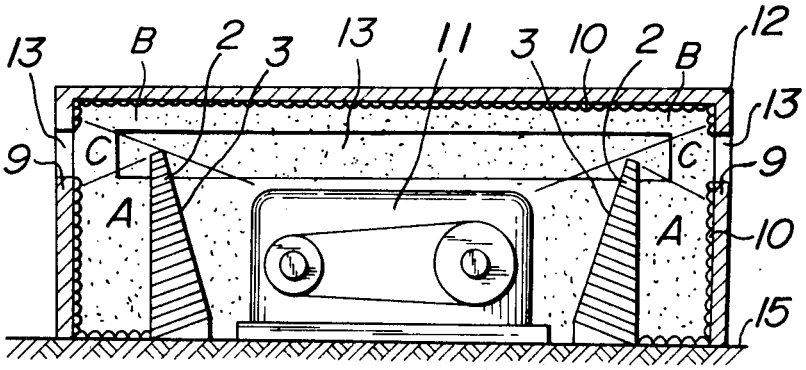
FIG. 12 is a front elevational view showing the device according to the invention in section which is applied to a power driven unit enclosed in a housing so as to reduce noise produced therefrom.

In FIG. 12 another use of the device 2 according to the invention in which a power driven unit 11 is surounded by the device 2 is illustrated. In the present use, the device 2 can not only reduce noise produced from the power driven unit 11 but also improve ventilation with the aid of the number of elongate hollow passages 3. Reference numeral 12 designates a housing for enclosing the power driven unit 11 and devices 2, 2 therein and provided at its opposed ends with outlet openings 13 located within the interference sound reducing regions C, C, respectively. As seen from FIG. 12, that part of the housing 12 which is located below the outlet opening 13 serves as a sound insulating wall 9. The housing 12 is lined with the sound absorbing material 10.

FIG. 13 shows in greater detail the embodiment of the device according to the invention shown in FIG. 5. As seen from FIG. 13, in the present embodiment, the device comprises a trapezoid-shaped hollow structural body composed of a supporting member 14 disposed on the substrate 5 and having an upper surface inclined from the substrate 5 by an angle $\alpha$ and a plurality of elongate hollow passages 3, 3 formed by a number of plates 4 superimposed one upon the other and spaced apart from each other by means of partition walls 15 sandwiched between adajcent plates 4, 4 and located near each end of the plate 4 to define the plurality of elongate hollow passages 3, 3.

The length L of the lower elongate hollow passage 3 is made larger than that of the upper elongate hollow passage 3 so as to make the outer contour of the device 2 trapezoid in section as shown in FIG. 13. The front face 3*a* of the elongate hollow passage 3 is opposed to the noise source 1 as shown in FIGS. 11 and 12. These elongate hollow passages 3, 3 cause noise passed therethrough to refract and lag in phase with respect to the direct propagation sound passed over the upper edge of the device 2. The difference in length L between two adjacent elongate hollow passages 3, 3 is determined such that the phase lag of the refraction propagation sound with respect to the direct propagation sound is made large. This results in a production of a destructive interference phenomenon, thereby producing an interference sound reducing region. In this case, the refraction propagation sound is intercepted by the sound insulating wall. The larger the downwardly inclined angle $\alpha$ the larger the defracting power of the device 2, and as a result, the interference sound reducing region becomes enlarged.

Figure 14:
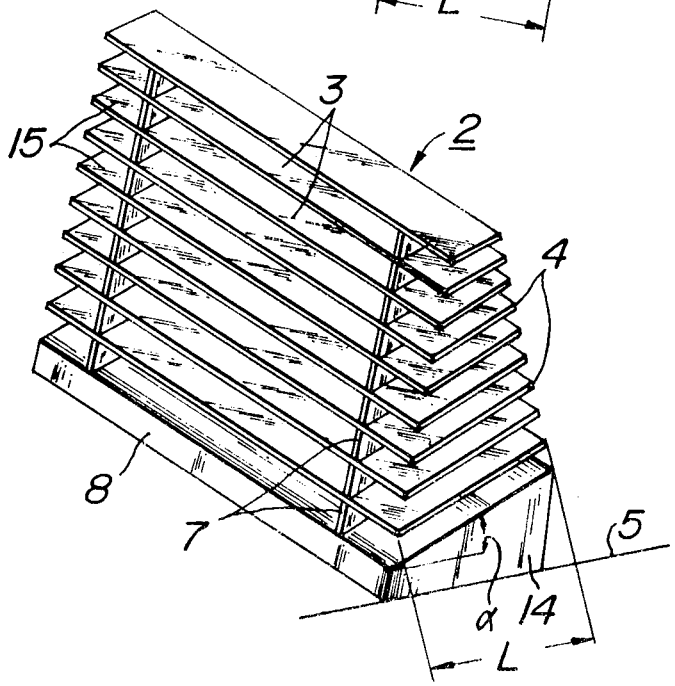
FIG. 14 is a perspective view of another embodiment of the device according to the invention which comprises a hollow structural body composed of a plurality of upwardly inclined elongate hollow passages.

FIG. 14 shows in greater detail the embodiment of the device according to the invention shown in FIG. 6. As seen from FIG. 14, the construction of the present embodiment is the same as that of the embodiment shown in FIG. 13, but the plates 4, 4 and the upper surface of the supporting member 14 are inclined upwardly from the substrate 5 by an angle $\alpha$.

In the present embodiment, if the difference in length L between two adjacent elongate hollow passages 3, 3 is the same as that of the embodiment shown in FIG. 13, the same destructive interference phenomenon is produced. Also, in the present embodiment, the larger the upwardly inclined angle $\alpha$ the larger the defracting power of the device 2, and as a result, the interference sound reducing region becomes enlarged.

If a frequency band of noise is in a range of 500 Hz to 2,000 Hz as in the case of noise produced from the contact portion of the rail 6 with the wheel 7 of the electric car 8 as shown in FIG. 11, it is preferable to separate adjacent elongate hollow passages 3, 3 of the device 2 from each other by at most 100 mm.

It is preferable that the device 2 is formed of a material having an excellent water resistant property and weather resistant property. Such material is selected from the group consisting of a metal material such as stainless steel and the like, inorganic material and synthetic resin material.

Figure 15:
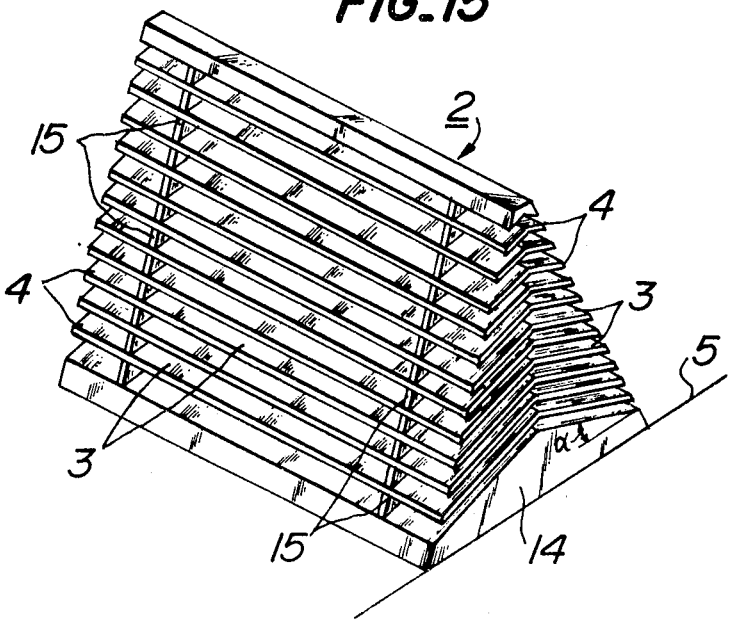
FIG. 15 is a perspective view of a further embodiment of the device according to the invention which comprises a hollow structural body composed of a plurality of triangular ridge-shaped elongate hollow passages.

FIG. 15 shows in greater detail the embodiment of the device according to the invention shown in FIG. 8. As seen from FIG. 15, in the present embodiment, the device 2 comprises a trapezoid-shaped hollow structural body composed of a supporting member 14 having a triangular ridge-shaped upper surface and a number of triangular ridge-shaped plates 4, 4 superimposed one upon the other on the upper surface of the supporting member 14 and spaced apart from each other by means of partition walls 15, 15 sandwiched between two adjacent plates 4, 4 and arranged near both ends of the plates 4, 4. These plates 4, 4 and the upper surfaces of the supporting member 14 are inclined upwardly from the substrate 5 by an angle $\alpha$ to form a trapezoid-shaped hollow structural body. The hollow structural body is provided between adjacent plates 4, 4 and their partition walls 15, 15 with a plurality of upwardly extending elongate hollow passages 3, 3.

Figure 16:
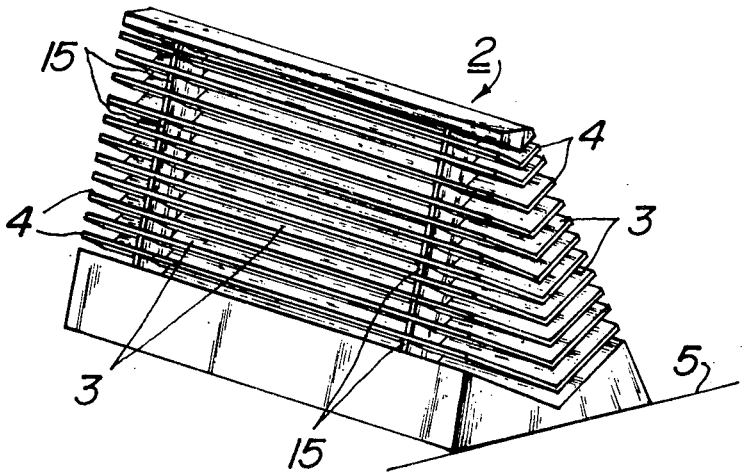
FIG. 16 is a perspective view of a still further embodiment of the device according to the invention which comprises a hollow structural body composed of a plurality of triangular groove-shaped elongate hollow passages.

FIG. 16 shows in greater detail the embodiment of the device according to the invention shown in FIG. 9. As seen from FIG. 16, in the present embodiment, the device 2 comprises also a trapezoid-shaped hollow structural body composed of a supporting member 14 with its upper surface triangular groove-shaped and a number of triangular groove-shaped plates 4 superimposed one upon the other and spaced apart from each other by means of partition walls 15, 15 sandwiched between two adjacent plates 4, 4 and arranged near both ends of the plates 4, 4. These plates 4, 4 and the upper surface of the supporting member 14 are inclined downwardly from the substrate 14 by an angle $\alpha$ to form a trapezoid-shaped hollow structural body having a plurality of triangular groove-shaped passages 3 formed between two adjacent plate 4, 4.

Experimental tests have shown that both the embodiments shown in FIGS. 15 and 16 make it possible to obtain substantially the same effect.

FIG. 17 shows another embodiment of the device 2 according to the invention which comprises a trapezoid-shaped hollow structural body composed of a supporting member 14 made integral with the body and a number of honeycomb-shaped square elongate hollow passages 3 inclined from the substrate 5 by an angle $\alpha$.

Figure 18:
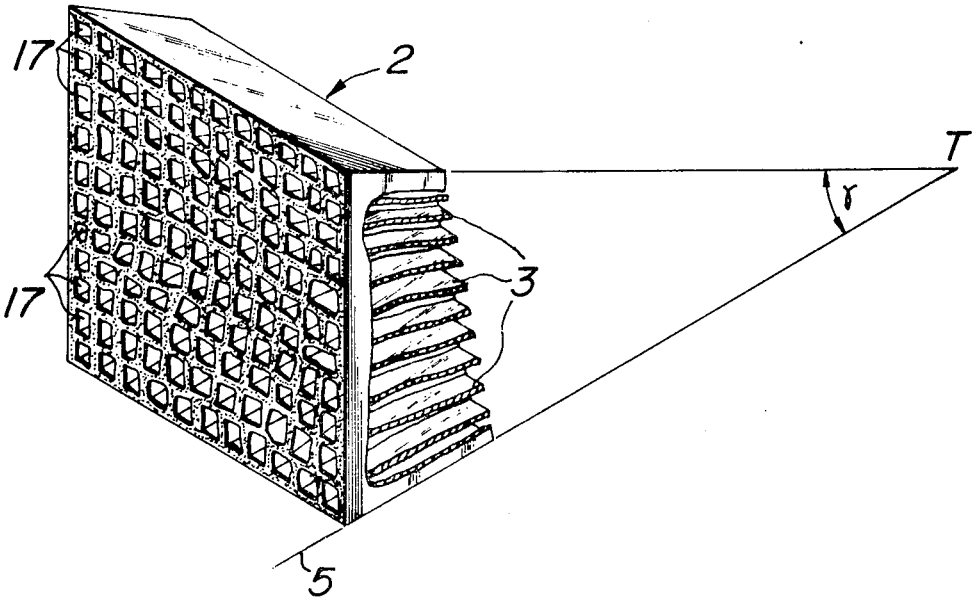
FIG. 18 is a perspective view showing a modified embodiment of the device shown in FIG. 17.

In FIG. 18 another embodiment of the device 2 according to the invenion in which a plurality of elongate hollow passages 3 are of many cross sectional configurations as shown by reference numeral 17 is shown. The uppermost passage 3 is inclined from the substrate 5 by the largest angle $\gamma$, but the lower the passages 3 the smaller the angle $\gamma$, so that the extensions of these passages are converged into a point T. The largest inclined angle $\gamma$ is determined by taking special quality of the noise, position of the noise source, for example, a distance between the sound insulating wall and the noise source into consideration.

In the device 2 shown in FIGS. 13 to 20, a plurality of elongate hollow passages 3 are regularly arranged, but the above mentioned function and effect of the device 2 may be obtained by arranging the elongate hollow passages 3 at random.

Figure 19:
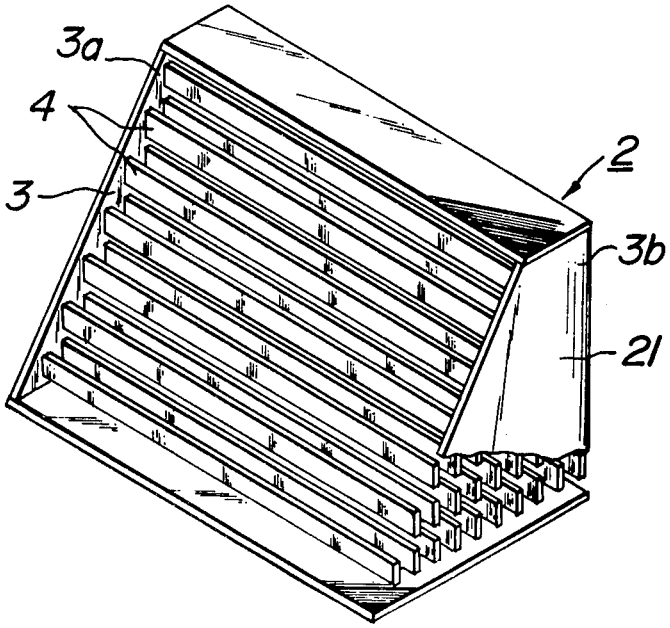
FIGS. 19 and 20 are perspective views showing another embodiments of the device according to the invention.

FIG. 19 illustrates a preferred embodiment of the device 2 according to the invention which is particularly adapted to be disposed between the side plate 19 of the electric car 8 and the sound insulating wall 9 as shown in FIG. 31. The device 2 shown in FIG. 19 comprises a trapezoid-shaped casing 21 with inlet and outlet sides 3*a*, 3*b* of the elongate hollow passages 3 open and a number of elongate plates 4 arranged in parallel and spaced apart from each other so as to form a plurality of elongate hollow passages 3. The plates 4 in the upper row are made small in number if compared with those in the lower row. This arrangement of the plates 4 causes also interference of the refracted propagation sound with the direct propagation sound and hence can produce a sound reducing region at an intermediate region between the direct propagation sound and the refraction propagation sound.

Figure 20:
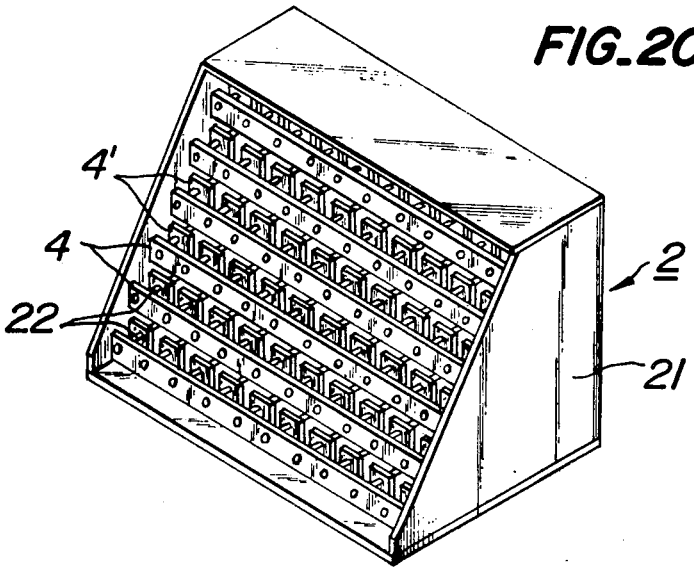

FIG. 20 shows a modified embodiment of the device 2 shown in FIG. 19. In the present embodiment, each plate 4' behind the front plate 4 is divided into a number of small separate pieces connected by rods 22, respectively, so as to make the acoustical medium density large. The present embodiment is substantially the same in function and effect as the embodiment shown in FIG. 19.

FIG. 21 illustrates an experimental test apparatus for measuring the sound pressure in dB of the noise emitted from a speaker S and having a center frequency of 1,000 Hz. The noise emitted from the speaker S was measured at a point M located on a line perpendicular to the substrate 5 and above the upper edge of the sound insulating wall 9 and a point N located on the vertical line in the rear of the sound insulating wall 9. In front of the new speaker S is disposed the sound reflecting plate 16. The device 2 according to the invention is disposed between the sound insulating wall 9 and the speaker S. That surface of the sound insulating wall 9 which is opposed to the device 2 and ground between the sound insulating wall 9 and the device 2 were covered with a sound absorbing material 10 formed of glass wool.

The measurement was effected in the presence and absence of the device 2 and yielded the data shown in the following table.

| Measuring point | Device according to the invention | |
|---|---|---|
| | Presence | Absence |
| M | 58 dB | 67 dB |
| N | 50 dB | 57 dB |

As seen from the above table, the presence of the device 2 according to the invention ensures a significantly large sound reducing effect at the point M located above the upper edge of the sound insulating wall 9 and where substantially no sound reducing effect is obtained, and also at the point N located in the rear of the sound insulating wall 9.

Figure 22:
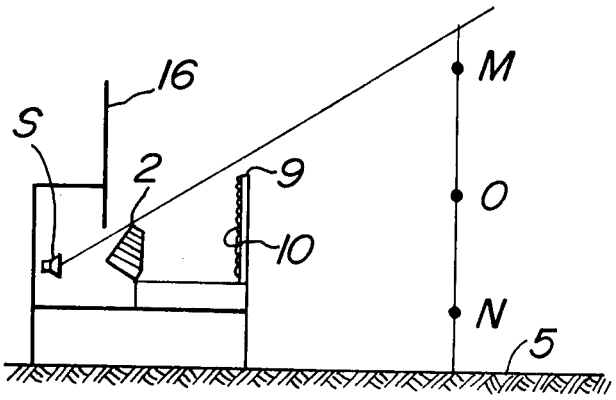
FIG. 22 is a diagrammatic view showing another experimental test apparatus in the device according to the invention which is used to control propagation direction of noise produced from the contact portion of a rail with a wheel of an electric car.

FIG. 22 shows an experimental test apparatus in which the device 2 according to the invention is used to control propagation direction of noise produced from the contact portion of a rail with a wheel of an electric car. The apparatus comprises a sound insulating wall 9 with a sound absorbing material 10, a device 2 according to the invention, a speaker S which is a noise source located at the contact portion of a rail with a wheel of an electric car, and a sound reflection plate 16 which is a side plate of the electric car. In the present test, let it be assumed that noise produced from the contact portion of a rail with a wheel of an electric car be measured at three points M, O, N located on a line perpendicular to the substrate 5 and positioned in the rear of the sound insulating wall 9. For this purpose, the speaker S is designed to deliver a band noise having a center frequency of 1,000 Hz. The experimental tests have produced the surprising result that the presence of the device 2 according to the invention ensures a significant reduction of noise in dB if compared with that obtained in the absence thereof as can be seen from the following table.

| Measuring point | Measuring condition | Absence of device according to the invention | | | Presence of device according to the invention | |
|---|---|---|---|---|---|---|
| | | | Presence of sound insulating wall | | Presence of sound insulating wall | |
| | | Absence of sound insulating wall | Without sound absorbing material | With sound absorbing material | Without sound absorbing material | With sound absorbing material |
| M | | 82 dB | 82 dB | 82 dB | 74 dB | 70 dB |
| O | | 84 dB | 71 dB | 70 dB | 61 dB | 57 dB |
| N | | 73 dB | 64 dB | 62 dB | 53 dB | 49 dB |

As explained hereinbefore, the use of the device for controlling propagation direction of noise according to the invention ensures a refraction of the noise propagation direction and at the same time a lag in phase thereof with respect to the direct propagation sound passed over the upper edge of the device and further provides the important advantage that a destructive interference phenomenon occurs to produce a sound reducing region located between the direct propagation sound and the refraction propagation sound. Thus, the invention provides an economical way of concentrating noise towards a sound insulating means such as a sound insulating wall disposed on a substrate such as an elevated railroad, highway and the like and can be applied effectively to improve the sound reducing effect of the sound insulating wall. In addition, if the refractive power of the device is made large, it is possible to make the height of the sound insulating wall low and eventually omit it when the refraction propagation sound is absorbed by a sound absorbing material.

As seen from the above, the device according to the invention is simple in construction, can be used as a device for significantly reducing the noise and contributes greatly to industry.

In accordance with the invention, the angle $\alpha$ of each elongate hollow passage 3 with respect to the substrate 5 is defined to an angle in a range of 30° to 80° and the base angle $\beta$ of the trapezoid-shaped hollow structure body of the device 2 is defined to an angle in a range of 30° to 80°.

In FIGS. 23(*a*), 23(*b*), 23(*c*) is shown an experimental test apparatus in which three devices 2 constructed according to the invention and comprising modified hollow structural bodies are disposed between a speaker S and measuring points M, O, N.

In FIG. 23(*a*) is shown a device 2 whose hollow structural body is rectangular in section and has a base angle of 90°. In FIG. 23(*b*) is shown a device 2 according to the invention whose hollow structural body is trapezoid in section and has a base angle $\beta$ of smaller than 90°. In FIG. 23(*c*) is shown a device 2 according to the invention whose hollow structural body is also trapezoid in section and has a base angle $\beta$ of smaller than 90°. The device 2 shown in FIG. 23(*c*), however, is disposed on a supporting member 14 having an upper surface inclined from the substrate 5 by an angle $\alpha$. Each of these devices 2 shown in FIGS. 23(*a*), 23(*b*) comprises a plurality of elongate hollow passages 3 inclined from the substrate 5 by the same angle $\alpha$. In the present experimental tests, the noise emitted from the speaker S is received and measured at three points M, O, N. The point M is located on an extension of a line connecting the speaker S to the upper edge of the device 2, the point N is located at a crossing point of a line drawn from the point M and perpendicular to the substrate 5 with an extension of an axial line of the speaker S and O is a midpoint between the two points M and N.

In FIG. 24 are shown curves (*a*), (*b*), (*c*) plotted by the results of the above experimental test apparatuses shown in FIGS. 23(*a*), 23(*b*), 23(*c*), and illustrating changes of the amount of reduced sound in dB in function of an angle $\alpha$ of the elongate hollow passage 3 of the device 2, respectively.

The amount of reduced sound shall be understood to means a difference between a sound pressure level measured in the presence of the device 2 and a sound pressure level measured in the absence of the device 2.

As seen from FIG. 24, if the angle $\alpha$ is larger than 30°, the amount of reduced sound becomes rapidly increased. Comparison to the curve (*a*) with the curves (*b*) and (*c*) show that the device 2 whose hollow structural body is rectangular in section and hence its base angle $\beta$ is 90°, is far inferior in the amount of reduced sound to the device 2 whose hollow structural body is trapezoid in section and hence its base angle $\beta$ is smaller than 90°.

In the present invention, the height H of each of the elongate hollow passages 3 shown in FIG. 17 is defined to a length which is shorter than one half the wave length $\lambda$ of the maximum frequency $f$ in a frequency range of that noise emitted from the noise source which is to be controlled.

For example, in the case of controlling the propagation direction of the noise emitted from the contact portion of the rail 6 with the wheel 7 of the electric car 8 as shown in FIG. 11, if the frequency of the noise is concentrated to a frequency range of 500 Hz to 2,000 Hz, the height H is given by $$H \leqq c/2f$$

where $c$ is a sound speed. As a result, the height H is defined to a length which is shorter than 85 mm.

In addition, it is preferable to determined a ratio of a total area at the sound inlet side 3a of the elongate hollow passages 3 to an overall area at the sound inlet side 3a of the device 4 to a value larger than 70%.

In FIG. 25 is shown an experimental test apparatus for measuring the influence of different heights H of the elongate hollow passage 3 of the device 4 upon the maximum frequency in the frequency range of the noise emitted from a speaker S. In this case also, the device 2 is located between the speaker S and the point N on the extension of the axial line of the speaker S and the noise is measured at the point O located at the midpoint between the point N and the point M where the vertical line on the point N and the extension of the line connecting the speaker S to the upper edge of the device 2 cross with each other.

In FIG. 26 are shown curves (*a*), (*b*), (*c*) illustrating the amount of reduced sound measured at the point O when the height H of the elongate hollow passage 3 of the device 2 shown in FIG. 17 is made 20 mm, 50 mm and 100 mm, respectively.

In FIG. 26, the curve (*a*) denoted by a symbol ● shows that if the heigth H of the elongate hollow passage 3 is defined to 20 mm, the maximum amount of reduced sound is obtained at substantially 8 KHz (calculation value is 8.5 KHz), the curve (*b*) denoted by a symbol ∘ shows that if the height H of the elongate hollow passage 3 is defined to 50 mm, the maximum amount of reduced sound is obtained at substantially 3 KHz (calculation value is 3.4 KHz) and the curve C denoted by a symbol · shows that if the height H of the elongate hollow passage 3 is defined to 100 mm, the maximum amount of reduced sound is obtained at substantially 1.6 KHz (calculation value is 1.7 KHz). This shows that if the height H of the elongate hollow passage 3 of the device 2 is defined to a length which is shorter than ½ times the wave length λ of the maximum frequency $f$ in the frequency range of that noise emitted from the noise source which is to be controlled, it is possible to significantly reduce the noise. Experimental tests have also yielded the result that the amount of reduced sound measured at the point N is far less than the amount of reduced sound measured at the point O.

In the present invention, the maximum length L of the elongate hollow passage 3 shown in FIG. 17 is defined to a length which is longer than 178 times the wave length λ of the minimum frequency $f$ in a frequency range of that noise emitted from the noise source which is to be controlled.

For example, in the case of controlling the propagation direction of the noise emitted from the contact portion of the rail 6 with the wheel 7 of the electric car 8 as shown in FIG. 11, if the frequency of the noise is concentrated to a frequency range of 500 Hz to 2,000 Hz, the maximum length L of the elongate hollow passage 3 is given by $$L \geqq c/2f$$

where $c$ is a sound speed. As a result, the maximum length L of the elongate hollow passage 3 is defined to a length which is longer than 340 mm.

The influence of different maximum length L of the elongate hollow passages 3 of the device 2 upon the amount of reduced sound in the frequency range of the noise emitted from the noise source 3 was measured with the aid of the experimental test apparatus shown in FIG. 21. In the case, the angle α of the elongate hollow passage 3 with respect to the substrate 5 was made 50° and the height H of the elongate hollow passage 3 was defined to 5 mm.

In FIG. 27 curves (*a*), (*b*), (*c*) illustrate the amount of reduced sound measured at the point O shown in FIG. 25 when the maximum length L of the elongate hollow passage 3 of the device 2 is made 260 mm, 325 mm and 540 mm, respectively.

In FIG. 27, the curve (*a*) denoted by a symbol ● shows that if the maximum length L of the elongate hollow passage 3 is defined to 260 mm, an increase of the amount of reduced sound is started from the minimum frequency of 600 Hz (calculation value is 653 Hz), the curve (*b*) denoted by a symbol ∘ shows that if the maximum length L of the elongate hollow passage 3 is defined to 325 mm, an increase of the amount of reduced sound is started from the minimum frequency of 500 Hz (calculation value is 523 Hz) and the curve (*c*) denoted by a symbol · shows that if the maximum length L of the elongate hollow passage 3 is defined to 540 mm, an increase of the amount of reduced sound is started from 300 Hz (calculation value is 315 Hz).

This shows that if the maximum length L of the elongate hollow passage 3 of the device 2 is defined to a length which is longer than ½ times the wave length λ of the minimum frequency $f$ in the frequency range of that noise emitted from the noise source which is to be controlled, it is possible to significantly reduce the noise.

FIG. 28 shows a further embodiment of the device 2 according to the invention in which each of the elongate hollow passages 3 is inclined downwardly and has a cross sectional configuration which is enlarged from its sound inlet side 3a to its sound outlet side 3b.

In FIGS. 29(*a*) and 29(*b*) is shown an experimental test apparatus by which noise emitted from the speaker S and propagated through the devices 2, 2' was measured at three points M, O, N. The point M is located on an extension of a line connecting the speaker S and the upper front edge of the device 2, 2', the point N is a crossing point of a line drawn from the point M and perpendicular to the substrate 5 with an extension of an axial line of the speaker S and the point O is a midpoint between the points M, N.

The elongate hollow passage 3 of the device 2 shown in FIG. 29(*a*) has its cross sectional area of 5 cm height × 5 cm width at its sound inlet side 3a which is gradually enlarged toward the sound outlet side 3b thereof, while the elongate hollow passage 3 of the device 2' shown in FIG. 29(*b*) has its cross sectional area of 5 cm height × 5 cm width at its sound inlet side 3a which is inclined from the substrate 5 by a constant angle of 50°.

FIG. 30(*a*) shows the amount of reduced sound measured at the point N. As seen from FIG. 30(*a*), at the point N there is not obtained considerably large sound reducing effect.

FIG. 30(*b*) shows the amount of reduced sound measured at the point O. As seen from FIG. 30(*b*), at the point O the presence of both the devices 2, 2' causes considerably large sound reducing effect. In addition, FIGS. 30(*a*) and 30(*b*) show that the sound reducing effect of the device 2 is higher and more uniform if compared with the sound reducing effect of the device 2'. This is because of the fact that the elongate hollow passage 3 with its cross sectional configuration enlarged from its sound inlet side 3a toward its sound outlet side 3*b* causes a considerably large sound reducing effect, and that the elongate hollow passages 3 inclined from the substrate 5 by different angles as shown in FIG. 28 causes a considerably large sound reducing effect over a wide frequency band.

FIG. 31 shows the device 2 according to the invention disposed between a side plate 19 of the electric car 8 and the sound insulating wall 9 for the purpose of concentrically propagating the noise emitted from the contact portion of the rail 6 with the wheel 7. In this case, a height *h* of the device 2 is made at least equal to a line $l_2$ which is lower than a line $l_1$. The line $l_1$ is a line connecting the contact point between the rail 6 and the wheel 7 to the upper front edge of the sound insulating wall 9, while the line $l_2$ is a line connecting a midpoint O on a line connecting a road bed 20 to the side plate 19 of the electric car 8 to the upper front edge of the sound insulating wall 9.

The device 2 according to the invention can be made as a separate structural body from the elevated substrate 5 as shown in FIG. 31 or it can be made integral therewith. The road bed 20 may be formed of slab road bed or ballast road bed.

FIG. 32 shows an experimental test apparatus in which the noise having a center frequency of 500 Hz and 1,000 Hz is emitted from three speakers S located at points M, O, N on a line perpendicular to the substrate 5. Between the speakers S and the sound measuring point T is arranged the device 2 such that a line connecting the point N to the point T is extended through the device 2, that a line connecting the midpoint O to the point T makes contact with the front upper edge of the device 2 and that a line connecting the point M to the point T passes a space above the device 2.

In FIG. 33 the amount of reduced sound measured at the point T in function with the speaker positions N, O, M is shown. As seen from FIG. 33, if the speaker S is located at the points N and O and hence the lines TN, TO passes through the device 2 or makes contact with the front upper edge of the device 2, the amount of reduced sound reaches to more than 10 dB, but if the speaker S is located at the point M and hence the line TM lies above the device 2, the sound reducing effect becomes rapidly decreased. This experimental test results show that the height *h* defined as above described makes it possible to use a relatively small device 2 and significantly increase the sound reducing effect of the sound insulating wall.

FIGS. 34 and 35 illustrate another embodiment of the device 2 according to the invention secured to the lower peripheral edge of the side plate 19 of the electric car 8. In the present embodiment, the lower end of the device 2 is projected below the line $l_1$ connecting the contact point of the rail 6 with the wheel 7 to the upper front edge of the sound insulating wall 9.

FIG. 36 shows a modified embodiment of the device 2 shown in FIGS. 13 and 14. In the present embodiment, the supporting member 14 of the device 2 shown in FIGS. 13 and 14 is turned upside down so as to be easily secured to the lower peripheral edge of the side plate 19 of the electric car 8.

In FIG. 37 is shown a modified embodiment of the device 2 shown in FIG. 19, in which provision is made of a supporting member 14 secured to the trapezoid-shaped casing 21.

FIG. 38 shows the use of the device 2 shown in FIG. 37, in which the upper supporting member 14 is made integral with the lower peripheral edge of the side plate 19 of the electric car 8.

In the embodiment shown in FIGS. 34 and 38, the device 2 is secured to or made integral with the lower peripheral edge of the side plate 19 of the electric car 8, but obviously the device 2 may be secured to a truck or a bed plate of the electric car 8.

Experimental tests have produced the result that the device 2 secured to the lower peripheral edge of the side plate 19 of the electric car 8 has the effect of rapidly reducing the noise propagated therethrough.

In FIG. 39 a device 2 according to the invention which is made small in size and mounted near a pantagraph 18 on the roof of the electric car 8 so as to propagate noise produced from the pantagrah 18 toward the sound insulating wall 9 is shown.

In FIG. 40 a fixture 37 for detachably mounting the device 2 according to the invention on the substrate 5 is shown.

In FIGS. 41 to 43 is shown the fixture 37 in greater detail. The fixture 37 is composed of a supporting member 38 projected in a vertical direction from the substrate 5. The supporting member 38 is provided at its base portion with a flange 39 which is secured to the substrate 5 by means of a fastening means such as a bolt 40 and the like. The upper surface of the supporting member 38 is inclined from the substrate 5 by a suitable angle $\alpha$ and is formed of a fitting portion 41 which is T-shaped in section. The supporting member 38 is provided at that side surface which is opposed to the sound insulating wall 9 with a tapered projection 38*a* which is urged against a projection 5*b* formed by grooves 5*a* provided on the surface of the substrate 5. A shock absorbing pad 42 is sandwiched between the fixture 37 and the substrate 5. 43 is a cover plate for covering and closing the grooves 5*a*.

The device 2 according to the invention is provided near at its lower side edge with a groove 2*b* adapted to be engaged with the T-shaped fitting portion 41. All of the fixtures 37 are secured to the substrate 5 and spaced apart from each other.

The device 2 according to the invention is supported by two adjacent T-shaped fitting portions 41 by slidably engaging the grooves 2*b* with corresponding T-shaped fitting portions 41 and by urging the lower edge of the device 2 against the projection 5*b* of the substrate 5. As a result, the device 2 is firmly supported by the fixture 37 secured to the substrate 5, so that there is no risk of the device 2 being dropped away from the fixture 37.

FIG. 42 shows a modified fixture 37 which is provided at the lower end of the T-shaped fitting portion 41 with a stopper 41*a* formed of an upwardly projecting end plate made integral with the T-shaped fitting portion 41. The stopper 41*a* engages with the side lower edge of the device 2 so as to stop its downward sliding movement. As a result, the use of the fixture 37 shown in FIG. 42 allows the omission of the projection 5*b* shown in FIG. 41.

FIG. 43 shows a thin elastic layer 44 formed of a soft rubber or soft synthetic resin and covering the peripheral surface of the T-shaped fitting portion 41. The thin elastic layer 44 serves to fill up a gap which might be formed between the side projection of the T-shaped fitting portion 41 and the side groove 2*b* of the device 2 and operate as a shock absorber. The thin elastic layer 44 may be provided on that surface only of the T-shaped fitting portion 41 which engages with the side groove 2*b* of the device 2.

In FIG. 44 is shown another modified fixture 37 which is provided with a supporting member 38 having a T-shaped fitting portion 41 which is not inclined from the substrate 5, but is parallel therewith. In the present embodiment, the device 2 according to the invention having a plurality of elongate hollow passages 3 inclined at an angle $\alpha$ with respect to the substrate 5 is provided at its each side with a side rectangular block 2c made integral with the device 2. The side rectangular block 2c is provided at its lower side surface with a groove 2b which engages with the T-shaped fitting portion 41. The fixture 37 is secured to the substrate 5 and then the device 2 is firmly supported by the fixture 37 by slidably engaging the groove 2b with the T-shaped fitting portion 41.

As seen from the above, the fixture 37 is capable of detachably supporting the device 2 according to the invention by merely bringing the groove 2b of the device 2 into engagement with the T-shaped fitting portion 41 of the fixture 37. As a result, the device 2 can be firmly secured to the substrate 5 in an efficient manner with the elongate hollow passages 3 inclined at an angle $\alpha$ with respect to the substrate 5. In addition, the projection-groove connection between the device 2 and the fixture 37 causes the device 2 to withstand wind pressure and vibration produced when the electric car runs on the rail. The presence of the shock absorbing pad 42 and the elastic layer 44 prevents the device 2 and the fixture 37 from being broken and hence use the device 2 and the fixture 37 for a long time. In addition, the device 2 can easily be replaced by a new one, takes up less space, requires a small operating time, and requires little maintenance.

What is claimed is:

1. A device for controlling a propagation direction of noise, comprising a hollow structural body composed of a plurality of elongate hollow passages superimposed one upon the other and spaced apart from each other, said passages being arranged in a propagation direction of noise emitted from a noise source, and adjacent passages located at least on a line perpendicular to said propagation direction and being different in length from each other, said noise emitted from said noise source passing through said adjacent passages of different length and refracted by all of said passages and lagged in phase with respect to direct propagation sound emitted from said noise source and passed over the upper edge of said hollow structural body to produce a sound reducing region.

2. A device for controlling a propagation direction of noise as claimed in claim 1, wherein said elongate hollow passages are inclined from a substrate by an angle $\alpha$ of 30° to 80°.

3. A device for controlling a propagation direction of noise as claimed in claim 1, wherein each of said passages is square in section and has a height H measured on a line perpendicular to the bottom surface of said passage, H being shorter than ½ times the wave length $\lambda$ of the maximum frequency $f$ in a frequency range to be controlled of the noise emitted from the noise source.

4. A device for controlling a propagation direction of noise as claimed in claim 1, wherein the maximum length L of said adjacent elongate hollow passages which are measured along said passages is defined to a length which is longer than ½ times the wave length $\lambda$ of the minimum frequency $f$ in a frequency range of that noise emitted from the noise source which is to be controlled.

5. A device for a propagation direction of noise as claimed in claim 1, wherein said plurality of elongate hollow passages are inclined with respect to the substrate, each cross sectional area of said passages being enlarged from its sound inlet side toward its sound outlet side.

6. A device for controlling a propagation direction of noise as claimed in claim 1, wherein the height h of the device is at least equal to either one of two lines which is lower than the other, said lines consisting of a line connecting a contact portion of a rail with a wheel of an electric car to the front upper edge of a sound insulating wall and a line connecting a midpoint between a road bed and the lower edge of a side plate of said electric car to the front upper edge of said sound insulating wall.

7. A device for controlling a propagation direction of noise as claimed in claim 1, wherein said device is secured to the lower peripheral edge of a side plate of an electric car such that at least the bottom portion of the device is projected below a line connecting a contact portion of a rail with a wheel of said electric car to the front upper edge of a sound insulating wall.

8. A device for controlling a propagation direction of noise as claimed in claim 1, wherein said plurality of elongate hollow passages are formed by a number of plates superimposed one upon the other and spaced apart from each other by means of partition walls sandwiched between adjacent plates.

9. A device for controlling a propagation direction of noise as claimed in claim 10, wherein said plates are ridge-shaped plates.

10. A device for controlling a propagation direction of noise as claimed in claim 8, wherein said plates are groove-shaped plates.

11. A device for controlling a propagation direction of noise as claimed in claim 1, wherein said plurality of elongate hollow passages are formed by a number of honeycomb-shaped square elongate hollow passages.

12. A device for controlling a propagation direction of noise as claimed in claim 1 and further comprising a fixture for supporting said device on a substrate along a railroad, said fixture comprising a supporting member projected in a direction perpendicular to said substrate and secured thereto, said supporting member being provided at its upper portion with a T-shaped fitting portion which is engageable with a groove provided on each lower side surface of said device.

* * * * *